US009263833B2

(12) United States Patent
Cheng et al.

(10) Patent No.: US 9,263,833 B2
(45) Date of Patent: Feb. 16, 2016

(54) ELECTRICAL CONNECTOR HAVING SHIELDING SHELL WITH REAR WALL

(71) Applicant: HON HAI PRECISION INDUSTRY CO., LTD., New Taipei (TW)

(72) Inventors: Chih-Pi Cheng, New Taipei (TW); Kuo-Chun Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/312,627

(22) Filed: Jun. 23, 2014

(65) Prior Publication Data

US 2014/0377969 A1 Dec. 25, 2014

(30) Foreign Application Priority Data

Jun. 21, 2013 (TW) ..... 102211722 U

(51) Int. Cl.

| | |
|---|---|
| ***H01R 13/6594*** | (2011.01) |
| ***H01R 13/6581*** | (2011.01) |
| ***H01R 13/66*** | (2006.01) |
| ***H01R 12/72*** | (2011.01) |

(52) U.S. Cl.

CPC ..... *H01R 13/6594* (2013.01); *H01R 12/724* (2013.01); *H01R 13/6581* (2013.01); *H01R 13/6658* (2013.01)

(58) Field of Classification Search

CPC ..... H01R 13/6581; H01R 13/6582; H01R 13/6658; H01R 13/6594; H01R 13/6595

See application file for complete search history.

(56) References Cited

U.S. PATENT DOCUMENTS

| | | | | |
|---|---|---|---|---|
| 6,165,015 | A * | 12/2000 | Wu et al. | 439/607.01 |
| 6,203,336 | B1 * | 3/2001 | Nakamura | 439/80 |
| 6,364,708 | B1 * | 4/2002 | Chen et al. | 439/607.37 |
| 7,527,526 | B1 * | 5/2009 | Chen et al. | 439/607.01 |
| 8,262,414 | B1 * | 9/2012 | Li | H01R 13/6273 439/607.35 |
| 8,337,248 | B1 * | 12/2012 | Lan et al. | 439/607.35 |
| 8,360,808 | B2 * | 1/2013 | Tsuchiya | 439/607.55 |

FOREIGN PATENT DOCUMENTS

TW M388767 U 9/2010

* cited by examiner

*Primary Examiner* — James Harvey
*Assistant Examiner* — Oscar C Jimenez
(74) *Attorney, Agent, or Firm* — Wei Te Chung; Ming Chieh Chang

(57) ABSTRACT

An electrical connector includes a base seat, a plurality of contacts fixed in the base seat and a shielding shell surrounding the base seat. The shielding shell defines a body portion retained in the base seat, a rear wall attached the rear face of the base seat, a pair of first soldering portions extending outside of the body portion and a pair of second soldering portions bending from the rear wall. The first soldering portion and the corresponding second soldering portion are adjacent to each other to form a same soldering position.

17 Claims, 6 Drawing Sheets

ELECTRICAL CONNECTOR HAVING SHIELDING SHELL WITH REAR WALL

BACKGROUND OF THE INVENTION

1. Field of the Invention

The present invention relates to an electrical connector, and more particularly to an electrical connector having a shielding shell with a rear wall.

2. Description of the Related Art

In the prior art, with the light, thin, short, small development trend of the electrical connector, the internal space of the electrical connector will be more narrow. Meanwhile, it needs to achieve high-speed in order to solve the transmission of big data. For example, it becomes a trend to increase a back wall to the shielding shell of the USB connector, however, it becomes an urgent problem that how to improve the structure of the back wall in order to achieve high-speed signal transmission.

Therefore, an improved electrical connector is highly desired to meet overcome the requirement.

BRIEF SUMMARY OF THE INVENTION

An object of the present invention is to provide an electrical connector having a shielding shell with a first soldering portion and a second soldering portion located in a same soldering position.

In order to achieve above-mentioned object, an electrical connector includes a base seat, a plurality of contacts fixed in the base seat and a shielding shell surrounding the base seat. The shielding shell defines a body portion retained in the base seat, a rear wall attached the rear face of the base seat, a pair of first soldering portions extending outside of the body portion and a pair of second soldering portions bending from the rear wall. The first soldering portion and the corresponding second soldering portion are adjacent to each other to form a same soldering position.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
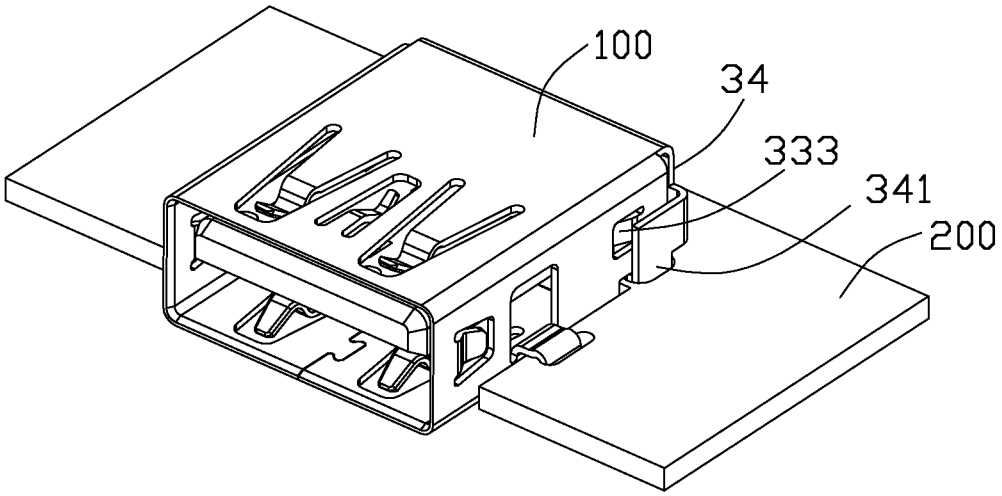
FIG. 1 is a perspective view showing an electrical connector mounted on a PCB in accordance with the present invention.
Figure 2:
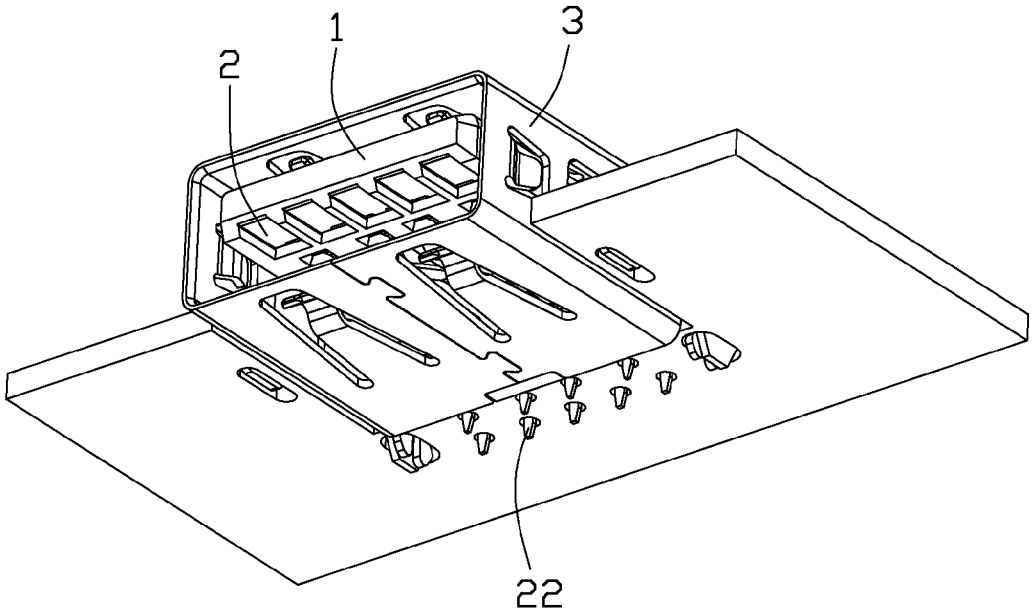
FIG. 2 is another perspective view of the electrical connector shown in FIG. 1.
Figure 3:
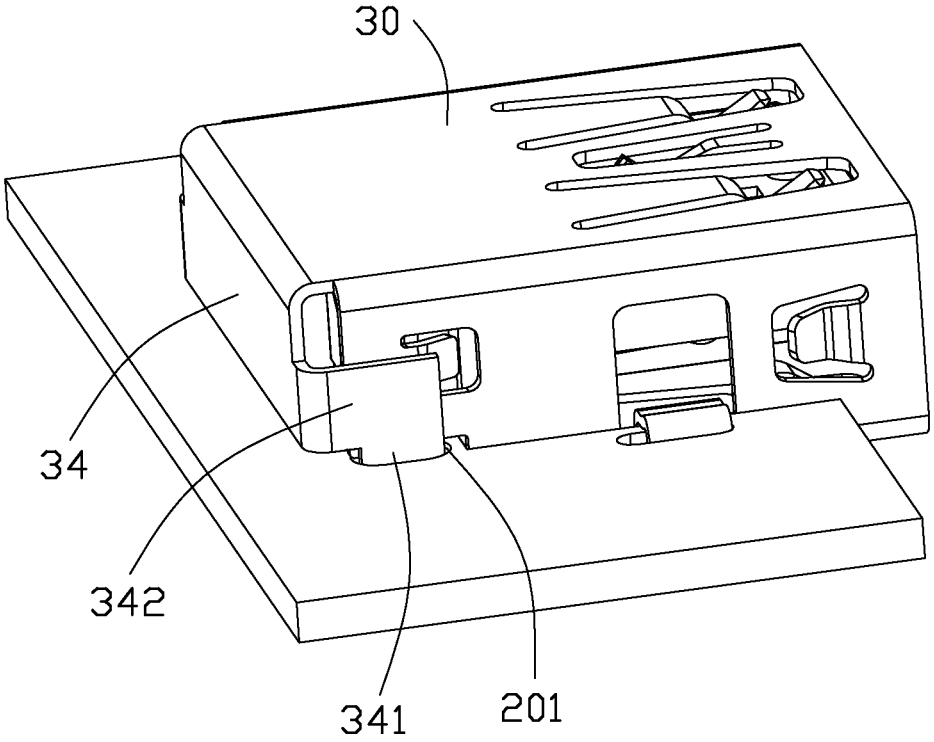
FIG. 3 is another perspective view of the electrical connector shown in FIG. 1.

Reference will now be made to the drawing figures to describe a preferred embodiment of the present invention in detail. Referring to FIG. 1 to FIG. 4, an electrical connector 100 mounted on a print circuit board 200 in accordance with the present invention. The electrical connector 100 includes a base seat 1, a plurality of contacts 2 fixed in the base seat 1 and a shielding shell 3 surrounding the base seat 1. The shielding shell 3 defines a body portion 30 retained in the base seat, a rear wall 34 attached to a rear face 101 of the base seat, a pair of first soldering portions 331 extending outside of the body portion 30 and a pair of second soldering portions 341 bending from the rear wall 34 of the shielding shell. The first soldering portion 331 and the corresponding second soldering portion 341 are adjacent to each other to form a same soldering position, which is used to insert into the soldering holes 201 of the print circuit board, in a preferred embodiment, the first soldering portion 331 and the corresponding second soldering portion 341 are affixing to each other so as to improve the strength of the soldering portions. When it is soldered by Surface Mounting Technology, the first and second soldering portions are welded in a same soldering pad of the print circuit board, therefore, the same soldering position means sharing a same soldering position of the print circuit board.

Figure 5:
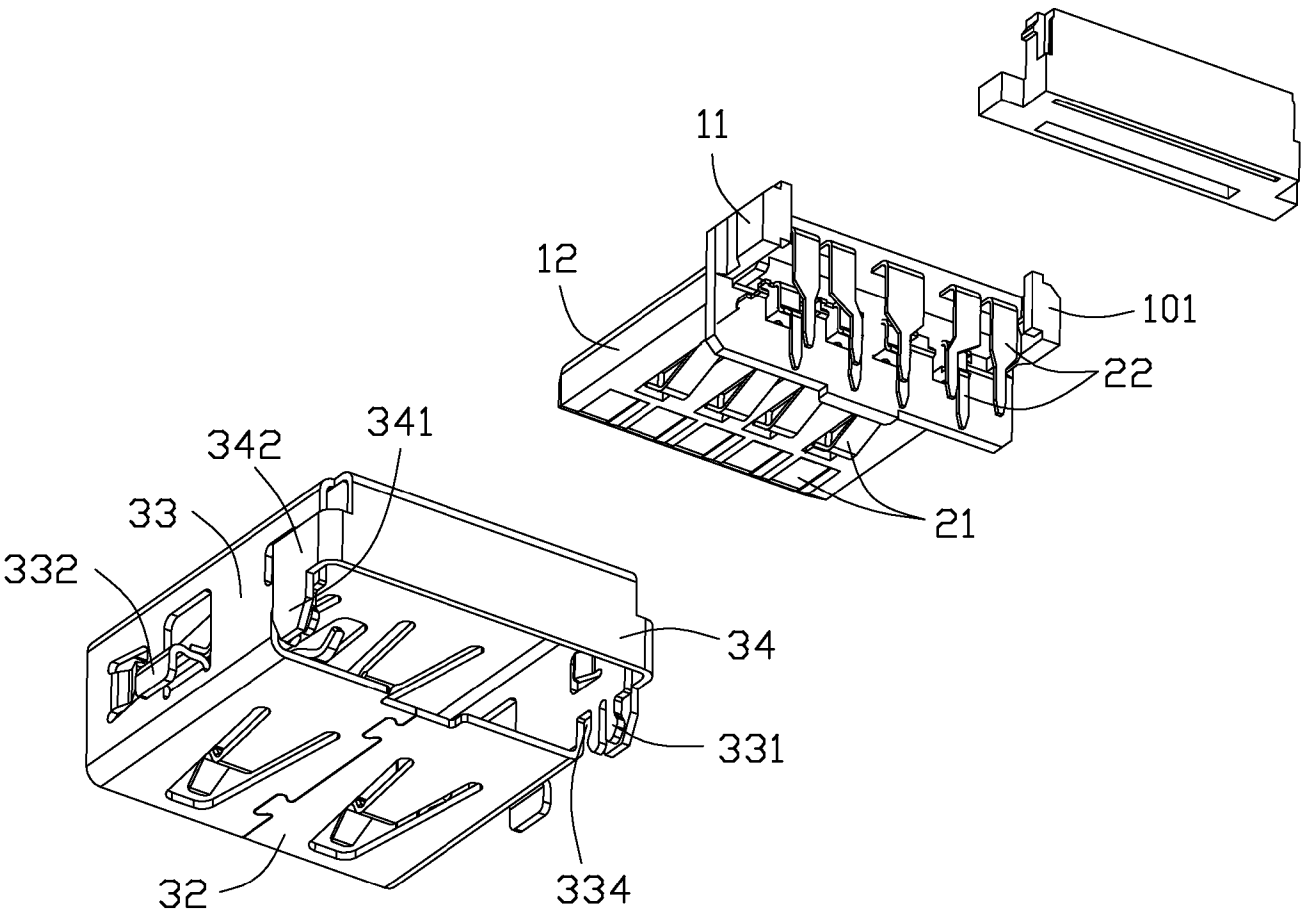
FIG. 5 is an exploded perspective view of the electrical connector shown in FIG. 1.
Figure 6:
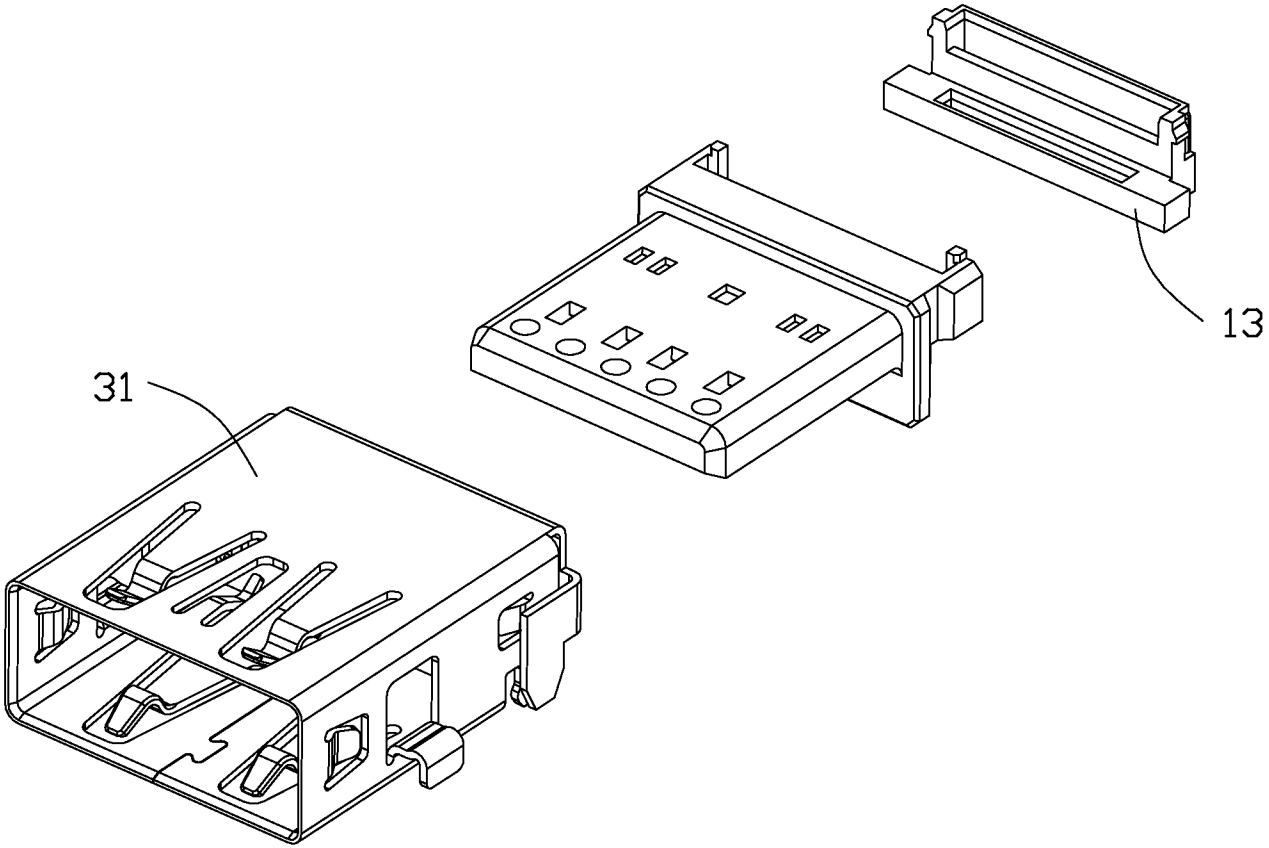
FIG. 6 is another exploded perspective view of the electrical connector shown in FIG. 5.

Referring to FIG. 5 and FIG. 6, the base seat is made of insulating material and defines a base portion 11 and a mating portion 12, each contact 2 defines a contacting portion 21 disposed in the mating portion 12 and a soldering portion 22, a positioning member 13 is used to locate and protect the soldering portions 22 of the contacts 22. In the present embodiment, the electrical connector is sink-type so that the soldering portions 22 of the contacts 2 are positioned below the rear portion of the base portion 11, in other embodiment, the soldering portions 22 can be located in the rear of the rear face 101 of the base seat. The body portion 30 of the shielding shell 3 is frame-shaped and includes a top wall 31, a bottom wall 32 and a pair of side walls 33 disposed oppositely and connected the top wall and the bottom wall, the rear wall 34 is bending from the top wall 31. The rear portion of the body portion 30 is retained in the base portion 11 of the base seat and the side wall 33 defines a tab 333 inclined forwardly and fixed in the base seat. The bottom wall is the part of the shielding shell close to the print circuit board.

The first soldering portion 331 extends downwardly from the side wall 33, the second soldering portion 341 is bending outwardly from one side of the rear wall 34 and located at outside of the first soldering portion 331, of course, the second soldering portion 341 also can be located inside of the first soldering portion 331. A pair of connecting portions 342 are connecting the second soldering portions 341 to the rear wall 34 and abutted against the side walls 33 of the shielding shell 3. The shielding shell 3 defines a sink notch 334 located below the rear face of the side wall 33, the first soldering portions 331 extend downwardly outside of the lower edge of the sink notch 334 and the connecting portions 342 of the second soldering portions 341 are flush with the lower edge of the rear wall 34 so that the connecting portions 342 of the second portions 341 and the rear wall 34 are abutted against the print circuit board 200 in order to increase stability when the electrical connector is assembled to the mounting notch 202 of the print circuit board. The shielding shell 3 defines a pair of third soldering portions 332 located in front of the first soldering portions 331, the third soldering portions 332 are torn from the side walls 33 and horizontally extending outwardly and bending downwardly. In the front-to-rear direction, the first soldering portions 331 are fork-shaped pins extending downwardly from the side walls 33, the second soldering portions 341 are spindle-shaped pins extending downwardly from the connecting portions 342 and the third soldering portions 332 are located at outside of the second soldering portions 341. In the transverse direction, the second soldering portions 341 are fully shielding the first soldering portions 331.

Figure 4:
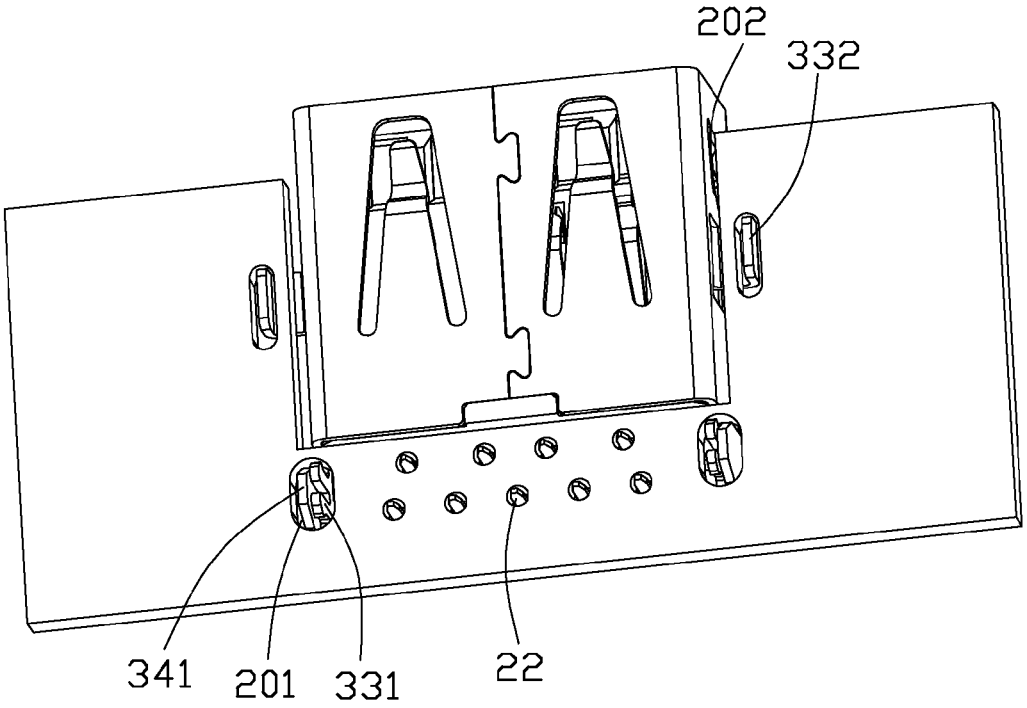
FIG. 4 is another perspective view of the electrical connector shown in FIG. 1.

Referring to FIG. 4, the first soldering portions 331 and the second soldering portions 341 of the shielding shell 3 are disposed on the opposite sides of the contacts. In the transverse direction, the second soldering portions 341 are bending from the shielding shell 3 and overlap with the soldering portions 22 of the contacts 2. The first soldering portion 331 and the second soldering portion 341 are set to a same soldering position and sharing a same soldering hole 201 of the print circuit board, it not only simplifies the arrangement of the print circuit board but also increases significantly the freedom of the circuit winding design.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

a base seat;

a plurality of contacts fixed in the base seat; and a shielding shell surrounding the base seat and defining a body portion retained in the base seat, a rear wall attached to a rear face of the base seat, a pair of first soldering portions extending outside of the body portion and a pair of second soldering portions bending from the rear wall; wherein the first soldering portion and the corresponding second soldering portion are adjacent to each other to form a same soldering position in a same hole of a printed circuit board.

2. The electrical connector as described in claim 1, wherein the body portion defines a top wall, a bottom wall and two oppositely side walls connecting the top wall and the bottom wall, the first soldering portions extend from the side walls, the second soldering portions bending forwardly from the side edges of the rear wall and attached to the outside of the first soldering portions.

3. The electrical connector as described in claim 2, wherein a pair of connecting portions are connecting the second soldering portions to the rear wall and abutted against the side walls of the shielding shell.

4. The electrical connector as described in claim 3, wherein the shielding shell defines a sink notch located below the rear face of the side wall, the first soldering portions extend downwardly outside of the lower edge of the sink notch and the connecting portions of the second soldering portions are flush with the lower edge of the rear wall.

5. The electrical connector as described in claim 1, wherein the shielding shell defines a pair of third soldering portions located in front of the first soldering portions.

6. The electrical connector as described in claim 5, wherein the first soldering portions are fork-shaped pins extending downwardly from the side walls, the second soldering portions are spindle-shaped pins extending downwardly from connecting portions.

7. The electrical connector as described in claim 5, wherein in the transverse direction, the second soldering portions are fully shielding the first soldering portions.

8. The electrical connector as described in claim 5, wherein the third soldering portions are torn from the side walls and horizontally extending outwardly and bending downwardly, in the front-to-rear direction, the third soldering portions are located outside of the second soldering portions.

9. The electrical connector as described in claim 1, wherein each contact defines a contacting portion disposed in a mating portion and a soldering portion, the first and second soldering portions of the shielding shell are disposed at outside of the soldering portions.

10. The electrical connector as described in claim 9, wherein in the transverse direction, the second soldering portions are overlap with the soldering portions of the contacts.

11. The electrical connector as described in claim 1, wherein the first and second soldering portions are attached to each other to form the same soldering position for being mounted into a same hole of a printed circuit board.

12. An electrical connector assembly comprising:

a printed circuit board defining a plurality of through holes;

an electrical connector mounted upon the printed circuit board and including:

an insulative housing having a base with a mating tongue forwardly extending therefrom in a front-to-back direction;

a plurality of contacts disposed in the housing with front contacting sections exposed upon the mating tongue and rear tail sections exposed upon the printed circuit board;

a metallic shell enclosing said housing and including opposite top and bottom walls and opposite lateral side walls to commonly define a mating port in which said mating tongue extends, and a rear wall covering a back side of the housing; wherein a pair of soldering legs unitarily extend forwardly from two opposite lateral side edges of the rear wall and intimately located outside of the corresponding lateral side walls, respectively, and respectively received in the corresponding through holes; wherein each of said side walls forms a mounting leg inserted into the same through hole with the corresponding soldering leg.

13. The electrical connector assembly as claimed in claim 12, wherein the soldering leg is not secured to the corresponding side wall.

14. The electrical connector assembly as claimed in claim 12, wherein the printed circuit board defines a notch, and a primary portion of said shell is received in the notch while the soldering legs are located behind the notch in said front-to-back direction.

15. The electrical connector assembly as claimed in claim 12, wherein the tail sections of the contacts are located between said pair of soldering legs in a transverse direction perpendicular to said front-to-back direction.

16. An electrical connector assembly comprising:

a printed circuit board defining a plurality of through holes;

an electrical connector mounted upon the printed circuit board and including:

an insulative housing having a base with a mating tongue forwardly extending therefrom in a front-to-back direction;

a plurality of contacts disposed in the housing with front contacting sections exposed upon the mating tongue and rear tail sections exposed upon the printed circuit board;

a metallic shell enclosing said housing and including unitarily opposite top and bottom walls and opposite lateral side walls to commonly define a mating port in which said mating tongue extends, and a rear wall covering a back side of the housing; wherein a pair of soldering legs unitarily extend forwardly from two opposite lateral side edges of the rear wall and intimately located respectively outside of the corresponding lateral side walls in a transverse direction perpendicular to said front-to-back direction, and respectively received in the corresponding through holes; wherein the printed circuit board defines a notch, and a primary portion of said shell is received in the notch while the soldering legs are located behind the notch in said front-to-back direction; wherein the notch defines two opposite lateral sides and a rear side respectively confronting the lateral side walls and the rear wall of said shell, and each of said soldering legs is aligned with the corresponding side of the notch along said front-to-back direction.

17. The electrical connector assembly as claimed in claim 16, wherein each of said side walls forms a mounting leg inserted into the same through hole with the corresponding soldering leg.

* * * * *